US005369841A

United States Patent [19]

Bembnowski

[11] Patent Number: 5,369,841

[45] Date of Patent: Dec. 6, 1994

[54] HINGE, PARTICULARY FOR FURNITURE DOORS

[76] Inventor: Jorge Bembnowski, Rua Tenente Max Wolf 242, Ap. 15, Curitiba, Brazil

[21] Appl. No.: 65,986

[22] Filed: May 21, 1993

[30] Foreign Application Priority Data

May 28, 1992 [DE] Germany ..... 4217640
Jul. 15, 1992 [BR] Brazil ..... 9202749

[51] Int. Cl.[5] ..... E05F 1/08
[52] U.S. Cl. ..... 16/278; 16/296
[58] Field of Search ..... 16/278, 288, 294, 291, 16/296

[56] References Cited

U.S. PATENT DOCUMENTS

| | | | |
|---|---|---|---|
| 3,564,643 | 2/1971 | Salice | 16/278 |
| 3,744,086 | 7/1973 | Salice et al. | 16/164 |
| 3,940,828 | 3/1976 | Lautenschlaeger | 16/163 |
| 4,050,116 | 9/1977 | Salice | 16/163 |
| 4,065,829 | 1/1978 | Lautenschlager | 16/145 |
| 4,114,237 | 9/1978 | Grass | 16/145 |
| 4,152,811 | 5/1979 | Lautenschläger | 16/294 |
| 4,157,599 | 6/1979 | Holmes | 16/278 |
| 4,457,047 | 7/1984 | Lautenschläger | 16/294 |
| 4,543,686 | 10/1985 | Rock et al. | 16/294 |
| 4,596,062 | 6/1986 | Rock | 16/304 |
| 4,760,623 | 8/1988 | Toyama | 16/294 |
| 4,894,884 | 1/1990 | Lautenschläger, Jr. | 16/278 |

FOREIGN PATENT DOCUMENTS

| | | |
|---|---|---|
| 375138 | 7/1984 | Australia . |
| 7400397 | 5/1975 | Germany . |
| 2539197 | 1/1985 | Germany . |

*Primary Examiner*—P. Austin Bradley
*Assistant Examiner*—Chuck Y. Mah
*Attorney, Agent, or Firm*—Vickers, Daniels & Young

[57] ABSTRACT

A hinge, particularly for furniture doors, in which two fastening elements are connected via inner and outer link elements to form a linkage, the outer link element of which has a curved face and a vertex on which a longitudinally extending, active leg of a leg spring slides and holds the hinge both in its closed position and in its open position, when it presses on the vertex, but has no effect when it is seated against the curved face.

13 Claims, 8 Drawing Sheets

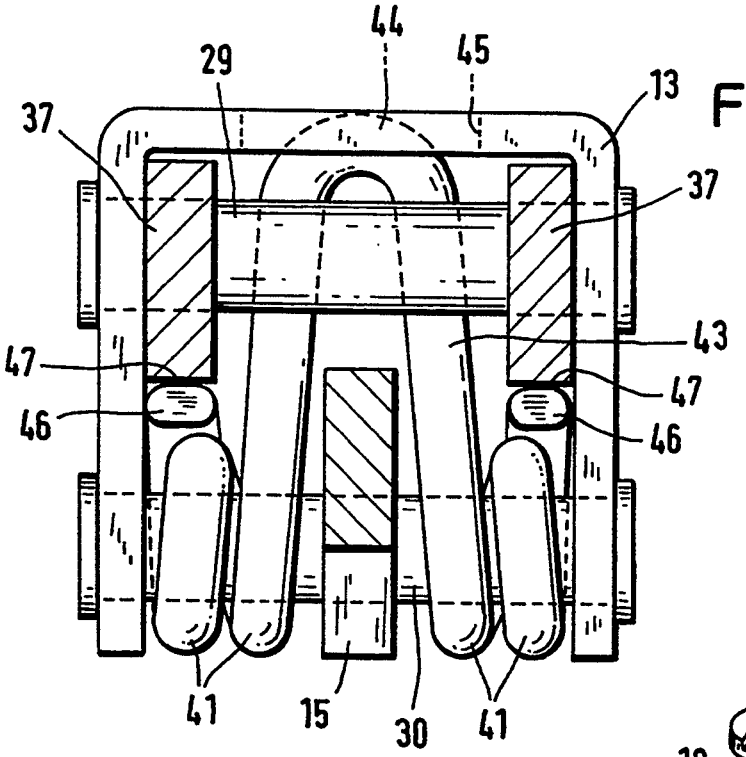
FIG.8
FIG.10
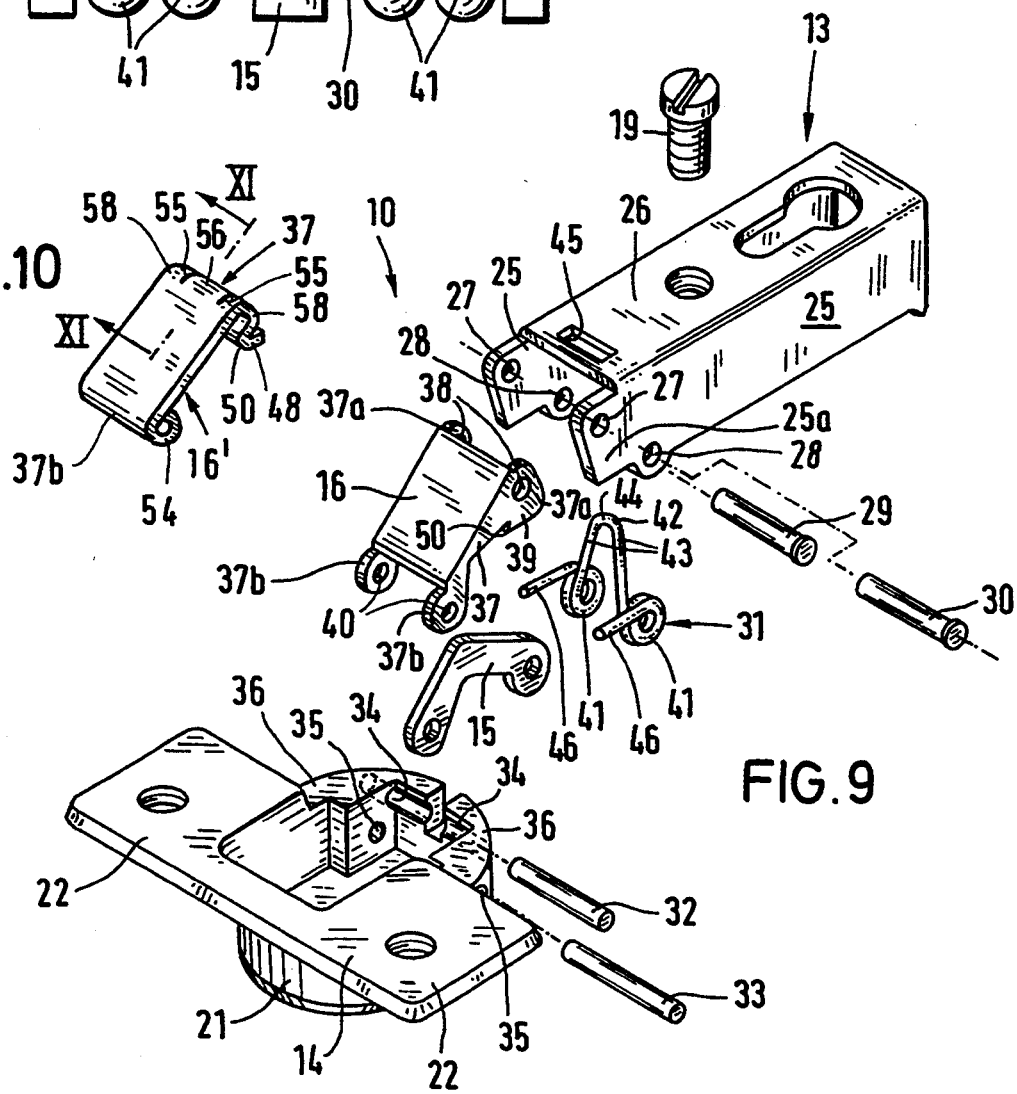
FIG.9

HINGE, PARTICULARY FOR FURNITURE DOORS

FIELD OF THE INVENTION

This invention relates to e hinge, particularly but not necessarily exclusively for furniture doors.

BACKGROUND OF THE INVENTION

Furniture door hinges are known which comprise first and second fastening elements, connected to each other by inner and outer link elements, each of which is articulated at one of its ends to the first fastening element and at its other end to the second fastening element. The outer link element executes a swivelling movement in two opposite directions on each complete opening or closing movement of the hinge and has a curved face which is partially cylindrical concentric with and disposed at a spacing from its fixed articulation axis and a vertex being disposed at one end of the curved face. A spring element acting on said lank element remains inactive when it is seated against the curved face end pushes the hinge into its closed position when it leaves the curved face.

In this type of known hinge the first fastening element is fixed to the body of the piece of furniture and the second fastening element is fastened to a door, and both fastening elements are attached to each other via the link elements to form a four-bar linkage acting in such a way That the door not only swings about a vertical axis when opened, but also at the same time projects beyond the front face of the piece of furniture and is displaced laterally in relation to the side edge of the latter. By this means a door placed on the front face of a piece of furniture takes up no space at the side near the body of the piece end cannot bump into immediately adjacent doors or drawers when it is opened.

A hinge of this known type is discharged in DE-C2-25 39 197. The curved face is disposed on two projections which project approximately et right angles into the first fastening element in the region of the fixed hinge pin of the outer link element. Rollers roll on these projections, and ere mounted on the ends of a spring which is located in the first fastening element and which holds the hinge in its closed position when the rollers disposed at the ends of the spring roll over the vertex and press laterally against the projections. Using this known hinge, the door can only be held in its closed position by the hinge. As soon as the spring rollers have ridden over the vertex on the projections of the outer link element, the door leaf can swing freely to end fro into its fully open position. This has the disadvantage that even fully open doors of pieces of furniture which are not exactly vertical can close again by themselves.

The known hinge also requires much space, since the projections which extend into the first fastening element and the spring acting on these projections are disposed behind one another in the longitudinal direction of the fastening element. Moreover the spring, which only serves to hold the hinge in its closed position, is costly to manufacture and difficult to install. In addition, the rollers et the free ends of the spring require a free-swinging axial pin and a lateral guide if they are not to slide off the curved faces. Furthermore, if the spring is constructed as a coil spring, it requires an additional bearing pin in the first fastening element of the hinge.

A hinge is also already known (U.S. Pat. No. 4 114 237) in which the free active leg of a leg spring slides along the back of the inner link element, which has a partially cylindrical curved face and a stop face disposed approximately perpendicularly thereto. In the closed position of the hinge the spring leg presses against the stop face and produces a torsional moment, which pushes the inner link element, and thereby also the second fastening element which is fixed to the door, into its closed position, and in this manner holds the door in its closed position. On opening the door, the spring leg surmounts the vertex between the stop face and the curved face. It then makes contact with the curved face and acts radially in relation to the fixed hinge pin of the inner link element, whereby it cannot exert a torsional moment on the latter. The movable, second fastening element and the furniture door fastened thereto can then be swung their open position or closed position without the application of force. In order also to hold the door in its open position to a certain extent, a latching recess, into which the free spring leg can slide, is provided on the partially cylindrical curved face which is concentric with the fixed hinge pin.

With this known hinge there is a risk that the free spring leg will pass through the latching recess on opening the door, whereupon the hinge pins of the hinge together with the link elements mounted on it have to absorb the inertial forces due to the torsional moment of the opening door, which can be quite considerable under some circumstances, and they may easily be damaged under these circumstances. In particular, the known hinge is only capable of functioning if the free spring leg of the leg spring is provided with a roller, which rolls on the back of the inner guide lever when the movable, second fastening element swivels. Since the leg spring requires a high initial stress in order to fulfil its holding function when the hinge is closed, and the hinge is also of relatively complicated construction, there are difficulties associated with mounting and guiding the tracking roller. However, without a tracking roller such as this the free spring leg is subjected to a very high level of wear, as are the curved face and the stop face. This is because the spring leg covers a relatively long path on the stop face and on the curved face on opening and closing the door, and the contact surfaces ere only small, so that a high specific contact pressure is transmitted from the spring leg to the curved face and the stop face. This wear is so high that a hinge without a tracking roller may even become unserviceable after a short period of use.

A hinge is also already known U.S. Pat. No. 4 065 829) by means of which a door which is fitted with it is held by the force of a spring both in its closed position and in its open position. The spring force is produced by a C-shaped leaf spring or spiral spring, which can bear on the fixed hinge pin of the inner lank element, and which exerts a permanent effective pressure on a projection on the outer link element. By this means the known hinge is permanently pushed either into the fully closed position or into the fully open position. A door fitted with this known hinge therefore has no intermediate position, but permanently either opens or closes, which in general is undesirable.

SUMMARY OF THE INVENTION

An object of the present invention is to provide a hinge of the type described in detail initially, with the lowest possible number of individual parts, which can be manufactured and installed easily, and which is constructed so that the hinge is of sturdy construction and is held by spring force in both its closed position and its open position, but by means of which the door is prevented from opening and closing by itself.

This object is achieved by providing the spring element with at least one active, longitudinally-extending spring element, which slides on the curved face of the outer link element and which presses against the vertex at one end of the curved face both at the end of the closing movement and at the end of the opening movement.

According to the present invention, the to-and-fro swinging movement of the outer link element which occurs both on opening and on closing the hinge is utilised both in the fully closed position and in the fully open position for the purpose of exerting a closing pressure by means of a single spring, although the outer link element does not reach the same position in the open position as it does in the closed position, since the difference is compensated for by a sliding movement of the spring leg, Since no idler roller is used, the spring leg makes contact reliably in each position of the vertex, so that a door fitted with the hinge according to the invention is held equally securely both in its closed position and in its open position, solely by means of the spring element, whilst it occupies a neutral position in all intermediate positions and can easily be both moved and stopped.

It is advantageous if the outer link element has two projections aligned in the same direction, on each of which a curved face and a vertex are disposed, and on which bears spring means constructed as a leg spring with two active spring legs. The point of application of the leg spring is then distributed over two contact locations on the outer link element.

The spring element for the hinge according to the invention is advantageously a coil spring loaded by bending, the turns of which are mounted on the fixed swivelling axis of the inner link element. The outer peripheral legs of this coil spring are then the active spring legs, which bear against the projections on the outer link element which are aligned in the same direction. In order to maintain its initial stress, the spring may be supported by means of a central leg directly or indirectly on the first, fixed fastening element. In association with this, two single leg springs may be disposed side by side on the fixed swivelling axis.

The inner link element is advantageously mounted on its fixed swivelling axis between turns of the spring, and the central leg of the spring may form a loop, the arms of which are disposed on both sides of the inner link element and which laterally support the latter. The inner link element of the hinge may be a flat plate or a rod. A very compact and simple form of construction is achieved in this manner.

In one preferred embodiment of the invention, the curved face and the vertex of the outer link element are located in a region disposed laterally between the hinge pins of the outer link element, and the distance of the curved face from the fixed swivelling axis is less than the distance between the fixed swivelling axes of the outer link element and of the inner link element. By this means the radius of the curved face becomes smaller and the sliding path becomes shorter, since the spring leg or legs of the leg spring have to travel on the curved face as far as the vertex when the outer link element swings to and fro during the opening and closing movement. Friction and wear on the spring are reduced by this means.

Since the curved face and the vertex are positioned in the vicinity of the fixed swivel pin of the outer link element, space for the spring is created between the fixed hinge pins of the outer and inner link elements, and the coil windings of the spring may thus be mounted directly on the fixed hinge pin of the inner link element. By this means the first fastening element fixed to the body of the furniture may in turn be made shorter.

It is particularly beneficial if the radial plane passing through the vertex and the fixed swivel pin of the outer link element forms an acute angle with the plane passing through the hinge pins of the outer link element. This bee the advantage that the vertex disposed at the inner end of the curved face is at a reduced distance from the fixed swivel pin of the outer link element when the hinge is in its fully open position, and thus the holding moment exerted by the spring via the vertex is less in the fully open position than it is in the fully closed position. When a door fitted with the hinge is fully opened, the hinge therefore has to absorb a lesser torsional moment and lower inertial forces than those which arise when the hinge is fully closed, where the furniture carcass can easily absorb the inertial forces of the door which is closing.

The projections which are aligned in the same direction, and on which the active spring arms of the spring means act, may be disposed on the flanges of an outer link element which has a U-shaped cross-section. They are then formed in one piece with the flanges of the outer link element, which may be manufactured as a simple punched component.

However, the projections may also be angled edge portions of a plate-like outer link element, which are formed by notches on the face of and extending in the longitudinal direction of the latter, and which have a central portion between them which is shaped to form an articulation eye surrounding the fixed swivel pin. The manufacture of a plate-like outer link element such as this is particularly simple and can be carried out at low cost.

The spring means is advantageously manufactured from a spring wire with a round cross-section. In this connection, at least the active spring leg or legs are provided with a flat portion by pressing, after forming the coil windings. The spring legs ere hardened by this deformation and in this manner are made particularly wear-resistant, without the spring coils losing their elasticity. At the same time, this results in the active spring legs having a flat portion along their free end which slides on the curved face or on the vertex; this flat portion prevents the spring leg from sliding off even a narrow curved face and the attached vertex.

Further features and advantages of the invention follow from the description given below and from drawings, in which preferred embodiments of the invention are described in more detail by way of examples.

BRIEF DESCRIPTION OF THE DRAWINGS

FIG. 8 is a front view, including a partial cross-section, of the pivoting end spring elements joined to a first fastening element which is to be fixed to the wall of the body of the furniture;

FIG. 9 is an exploded perspective view showing the individual parts of the first embodiment of the hinge according to the invention;

FIG. 10 is a perspective view of the outer link element of another embodiment of the invention;

DESCRIPTION OF THE PREFERRED EMBODIMENTS

Figure 1:
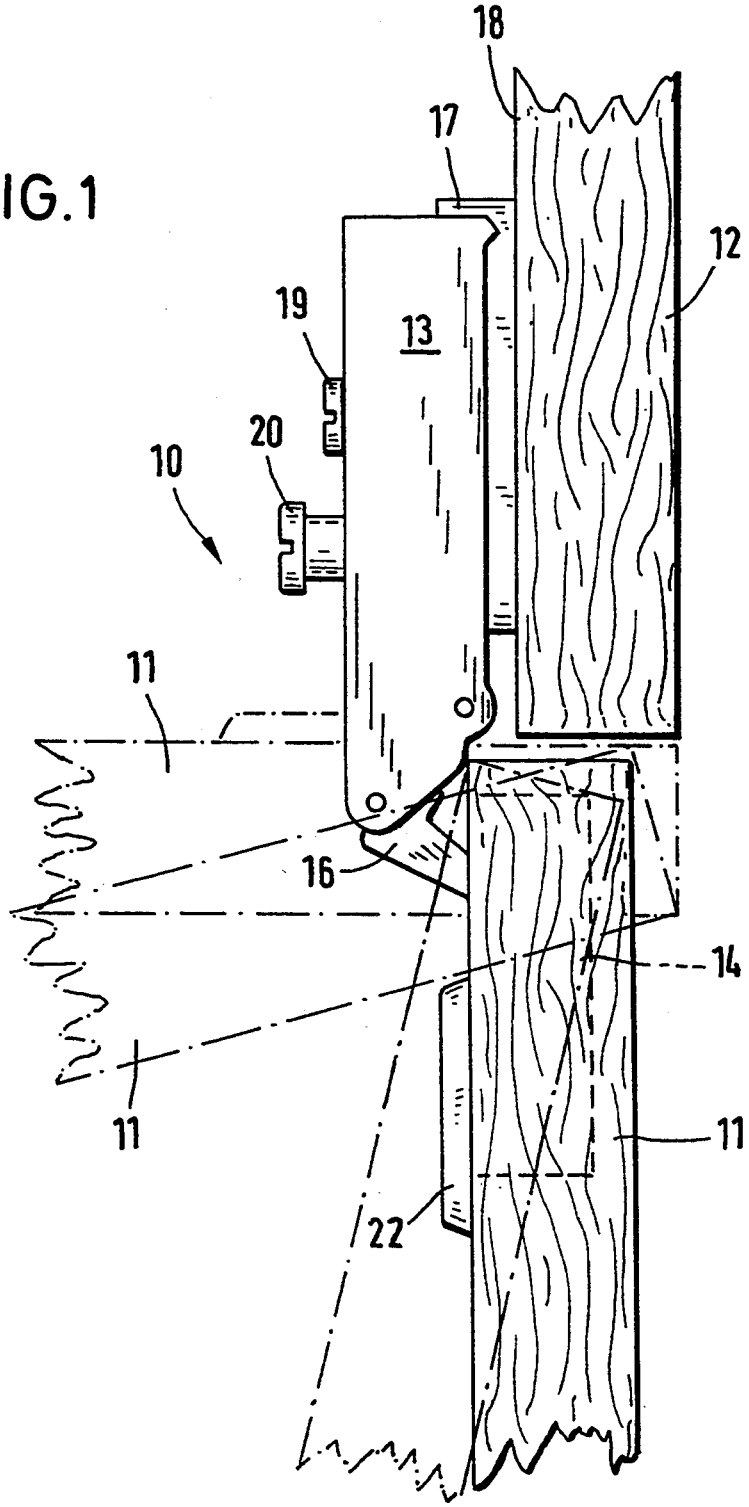
FIG. 1 is a plan view of a first embodiment of a hinge according to the invention, fastening a door to an inner wall of a body of an item of furniture, wherein the fully open position of the furniture door is represented by continuous lines, and its fully closed position and several intermediate positions are represented by dashdot lines.

The hinge 10 shown in the drawings is primarily intended for furniture doors 11 which are to be pivotally secured on the front of the body 12 of a piece of furniture, and which are therefore seated against the front face of the body and do not project into the interior of the body. However, the hinge may be used for other purposes, for example for fastening a lid to a box, for a garden gate or for other movable, hinged flaps.

As can be seen from the drawings, particularly from FIG. 9, the hinge 10 consists of a first, fixed fastening element 13 and a second, movable fastening element 14, which are connected in an articulated manner to each other by an inner link element 15 and an outer link element 16, and which form a four-bar linkage. The first fastening element 13 is fixed to an inner wall 18 of the furniture body 12 by means of a mounting plate 17; it is screwed to the mounting plate 17 by a fixing screw 19, and its distance from the mounting plate 17 can be adjusted by means of an adjusting screw 20.

The second, movable fastening element 14 has a pot-like, cylindrical part, which is also called a "drum" 21, and which has mounting lugs 22 disposed at its free upper edge. The drum 21 is inserted into a cylindrical recess 23 in the furniture door 11 which is provided for this purpose, whilst the mounting lugs 22 are fastened with screws to the inner face 24 of the door 11.

It may be seen from FIG. 9 that the first, fixed fastening element 13 has a U-shaped cross-section and that the side flanges 25 of the first fastening element 13 project at its front outer end beyond the web portion 28 of the first fastening element 13. Holes 27 and 28, with are aligned with each other in pairs, are disposed in These projecting flange ports 25*a*. A first, fixed hinge pin 29 for the outer link element 16 is inserted through the holes 27, whilst a second, fixed hinge pin 30 for the inner link element 15 and a spring element 31 is disposed in the holes 38. The inner link element 15 is attached to the movable fastening element 14 by a movable hinge pin 32, and the outer link element 16 is attached to the movable fastening element 14 by a movable hinge pin 33. The movable hinge pins 32, 33 are disposed in holes 34, 35 respectively, which are aligned with each other, and which penetrate the walls 36 of the drum 21. The term "movable hinge pin" means those hinge pins 32 and 33 by means of which the inner link element 15 and The outer link element 16 are attached to the second, movable fastening element and on which these link elements can swivel. The hinge pins 32 and 33 themselves are not movable, but are seated fixed within the pot-shaped drum 21.

In the embodiment of the invention illustrated in FIGS. 1 to 9, the outer link element 16 is formed by a plate with a U-shaped cross-section. The side flanges 37 of the element 18 have bearing holes 38 at their inner ends 37*a* for the fixed hinge pin 29, and they also each have a projection 39 there, both of which projections are aligned in the same direction and are of identical construction: their shape and purpose will be described in more detail below.

The side flanges 37 have further bearing holes 40 at their other, outer ends 37*b*, and are mounted on the movable hinge pin 33 inside the drum 21 by means of these bearing holes.

The spring element 31 is a coil spring or feather spring which is stressed by bending, and which is mounted by means of two lateral turns 41 on the second, fixed hinge pin 30, by means of which the inner link element 15 is also linked to the first, fixed fastening element 13. The two lateral turns 41 of the spring element 31 are joined in the centre by a central leg 42 forming a loop, the arms 43 of which are disposed on both sides of the inner link element 15, and the juncture 44 of which engages in a rectangular opening 45 in the web part 26 of the first, fixed fastening element 13.

The straight, outer peripheral legs 46 projecting from the lateral turns 41 are the active, longitudinally extending legs of the spring. They are of a considerable length and are seated against the end faces of the projections 39 of the outer link element 16. The spring element 31 is manufactured from a spring wire of round cross-section, and its longitudinally extending, active legs 46 are shaped after forming the turns by pressing transversely to the longitudinal direction to form wire arms of flattened or rectangular cross-section, flat portions 47 of which bear against the end face of the associated projection 39. The spring legs 46 are hardened and made wear-resistant in the region of their flat portions 47 by this subsequent deformation by pressing, without the elasticity of the spring being affected (FIG. 8).

The end edges of the projections 39 are constructed in a particular manner. They have a curved face comprising 8 partially cylindrical face 48 which is concentric with the fixed hinge pin 29, end which bends inwards at its end facing the movable hinge pin 33 to form there a convex vertex 50 which is slightly rounded.

Figure 2:
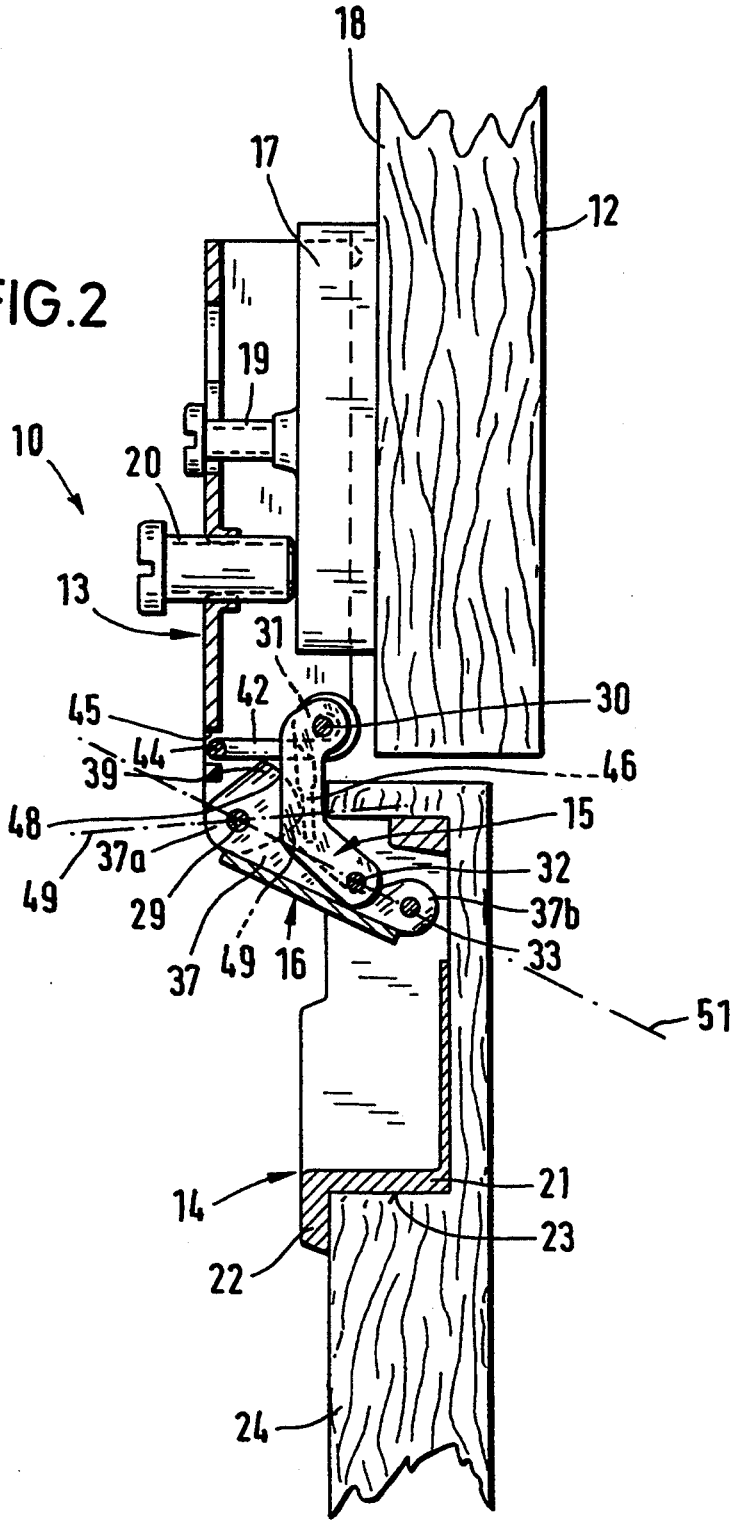
FIG. 2 is a plan section of the embodiment of FIG. 1 with the door fully open to show the hinge in the open position.
Figure 3:
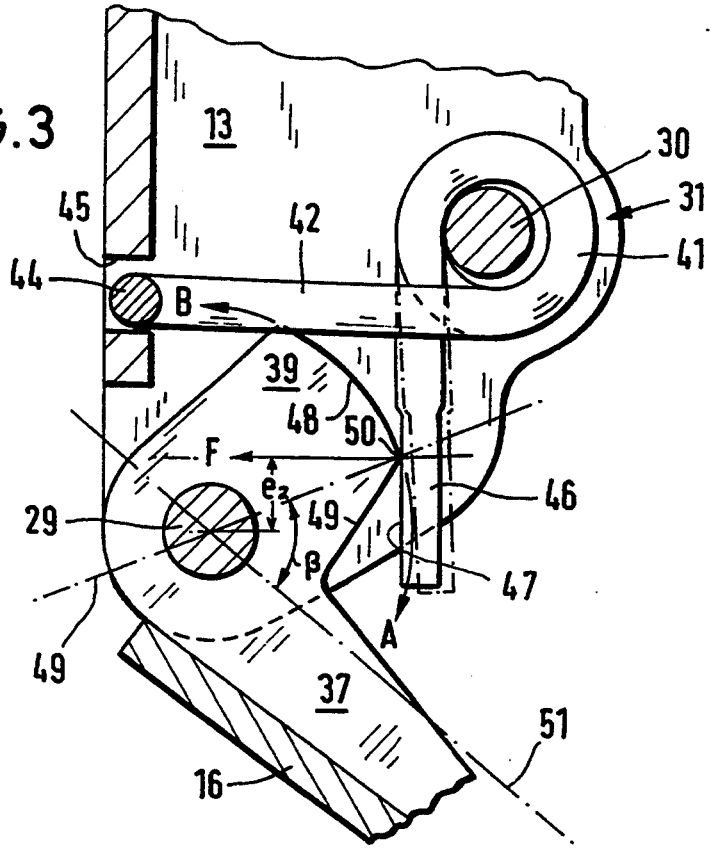
FIG. 3 shows a detail from FIG. 2 to a larger scale.
Figure 4:
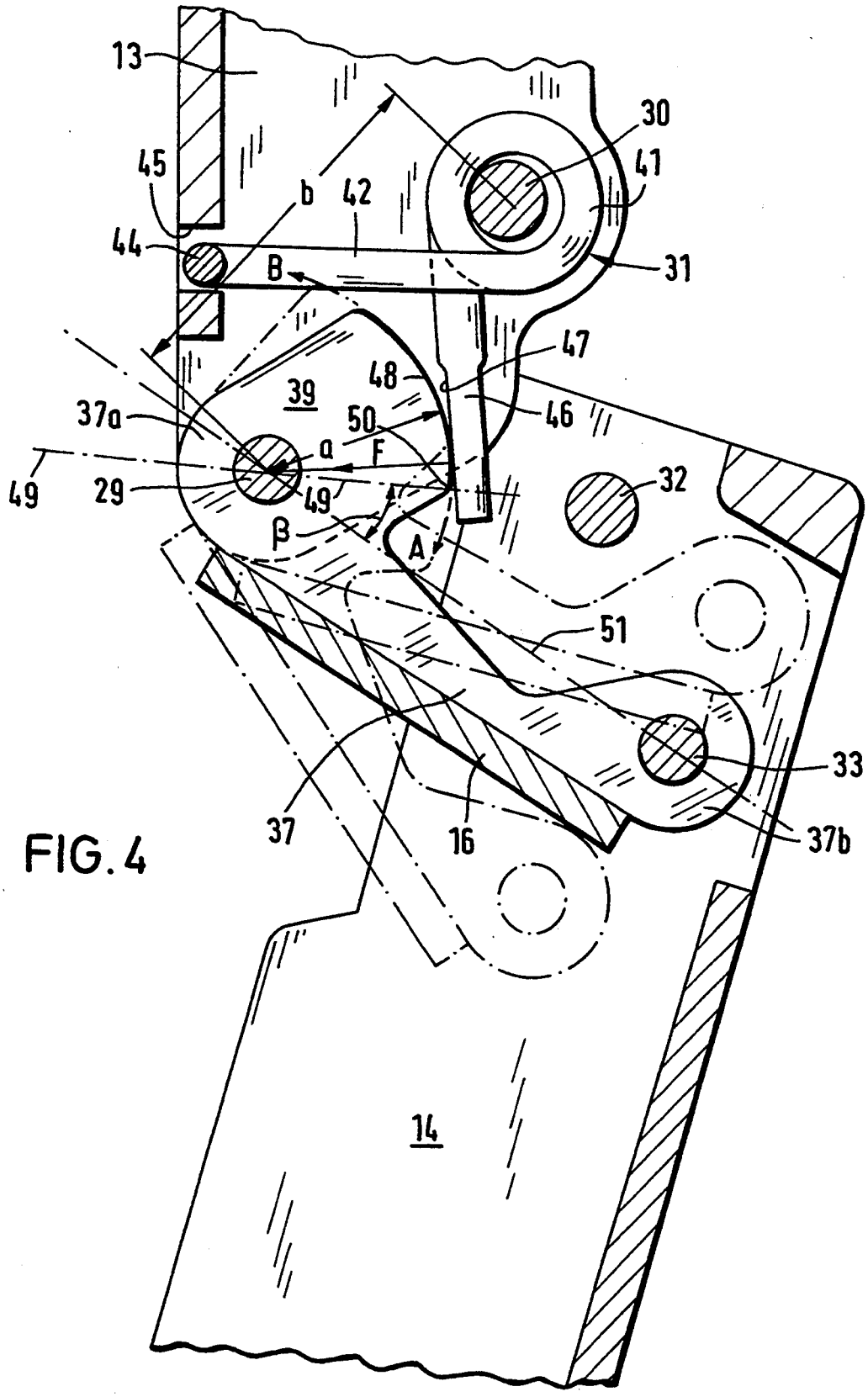
FIG. 4 is a plan section to the same scale as FIG. 3 but the inner link element has been omitted and the outer link element is represented by continuous lines, and by dash-dot lines in intermediate positions which arise on opening or closing the door and in which no torsional moment is exerted on the hinge.

It may be seen in particular from FIGS. 2 and 4 that the curved face 48 and the vertex 50 of the outer link element 16 are essentially located in 8 region which is laterally in the vicinity of end between the hinge pins 29 and 33 of the outer link element 16, and that the radial distance a of the curved face 48 from the fixed hinge pin 29 is less than the distance b between the fixed hinge pin 29 of the outer link element 16 and the fixed hinge pin 30 of the inner link element 15. It may also be seen that an acute angle $\beta$ is included between the radial plane 49 passing through the vertex 50 and the fixed hinge pin 29 of the outer link element 16, and the connecting plane 51 passing through the hinge pins 29 end 33 of the outer link element 16.

It may also be seen that the projections 39 on the side flanges 37 of the outer link element 16, which projections are constructed like the head of an axe, are inclined towards the movable hinge pin 33 of the outer link element 16, so that these projections 39 and the curved faces 38 disposed on them are located more in the vicinity of the connecting plane 51. By this means sufficient space is left between the projections 39 and the fixed hinge pin 30 of the inner link element 15 for the turns 41 of the spring element 31, the arms 46 of which can sit closely against the curved faces 48 and the vertexes 50.

Figure 6:
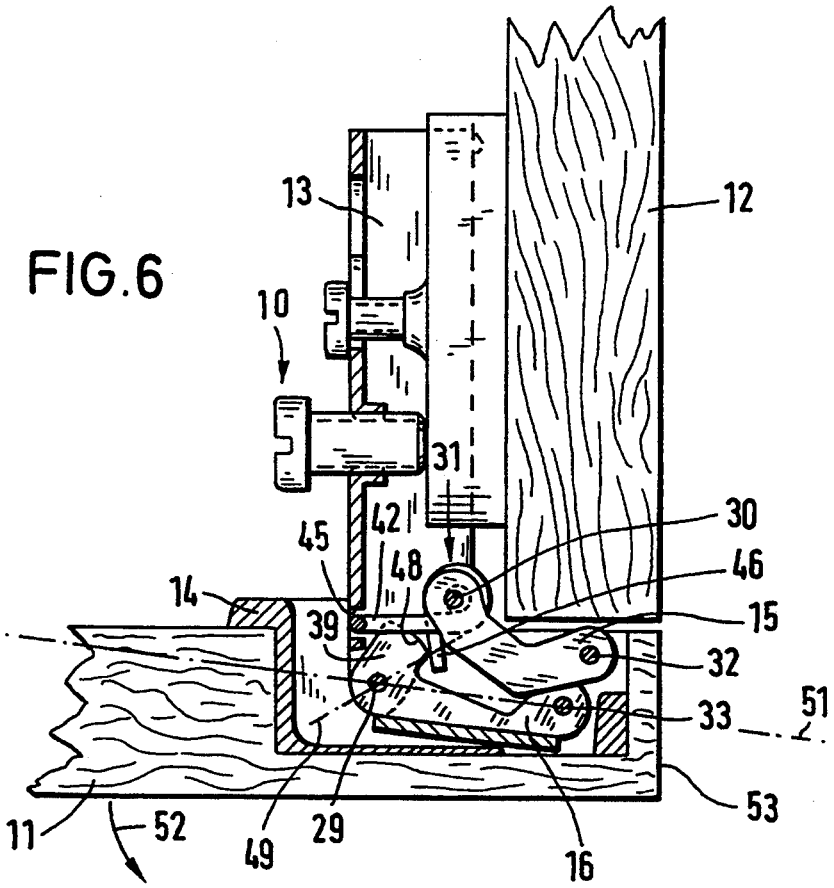
FIG. 6 is a plan section corresponding to FIG. 2, showing the door fully closed.
Figure 7:
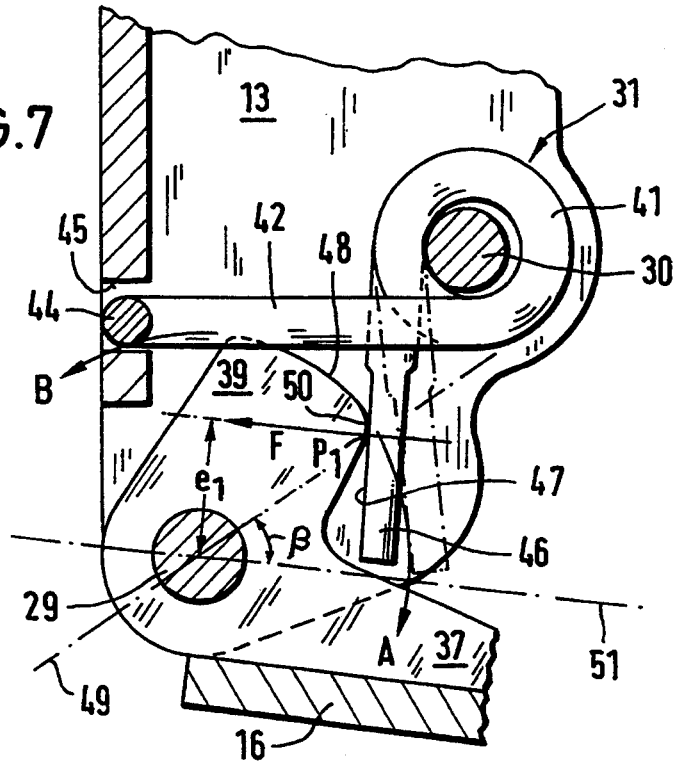
FIG. 7 shows a detail from FIG. 6, to a larger scale, which illustrates the hinge in its closed position.

When the door 11 is closed, the active legs 46 of the spring element 31 are seated with an initial loading against the vertexes 50 of the projections 39 (FIGS. 6 and 7). The spring force F exerted on the projections 39 of the outer link element 16 by the spring legs 46 at the point of contact $P_1$ then acts with a high degree of eccentricity $e_1$ in relation to the first, fixed hinge pin 29, and generates a torsional moment $F.e_1$ which attempts to swing the outer link element 16 anticlockwise as seen in FIGS. 6 and 7. By this means a force directed towards the body 12 of the piece of furniture is exerted through the movable hinge pin 33 onto the movable fastening element 14 and so onto the door 11 also; the door 11 is thus held in its closed position.

Figure 5:
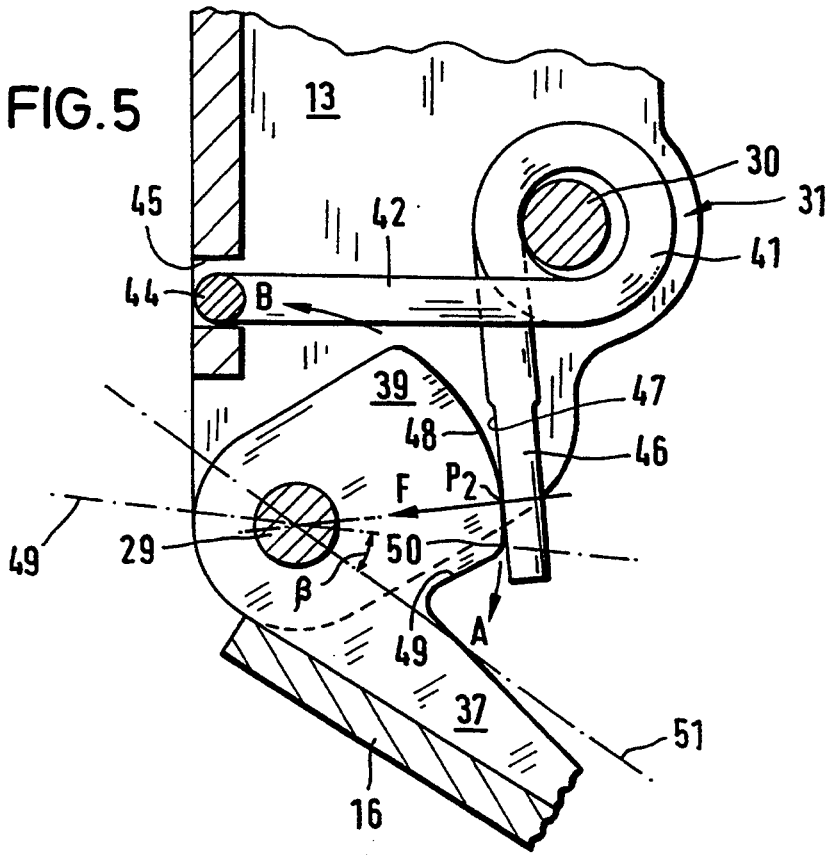
FIG. 5 shows a detail from FIG. 4.

When the door 11 is to be opened and a pull is exerted on the door 11 in the direction of the arrow 52 and, the door leaf in FIG. 6 swings anticlockwise. At the same time, however, the rear edge 53 of the door 11 also moves away from the body 12, whereupon the inner link element 15 and at first also the outer link element 16 pivot in a clockwise direction, and the vertex 50 at the end of the curved face 48 moves along a circular path about the first, fixed hinge pin 29 in the direction of the arrow A (FIG. 7). In this connection the spring legs 46 ride over the vertexes 50 and then become seated against the curved faces 48 on the projections 39 (FIGS. 4 and 5). In this intermediate position, in which the door is only partly open, the spring force F which is transmitted to the curved face 48 at the point of contact $P_2$ is applied radially and directly onto the first, fixed hinge pin 29 and cannot generate a moment in relation to this pin. It therefore does not affect or impede the link movement of the outer link element 16, so that the door may be opened further and stopped without hindrance and it is pushed neither into its closed position nor into its open position.

When the door opens further, the inner link element 15 swings further in a clockwise direction; however, the direction of swing of the outer link element 16 is reversed as soon as the door 11 has reached a central position of swing. Up to that point, the point of contact P between each outer spring leg 46 and the projection 39 seated against it only covers a short distance along the curved face 48 it the direction B.

When the door opens still further, the outer link element 16 again swings in an anticlockwise direction, whereupon the legs 46 of the spring element 31 move along the curved faces 48 towards the vertexes 50 at the end of the curved faces 48.

However, in the fully open position (FIGS. 2 and 3) the outer link element 16 does not quite return to the initial state which it adopted in the fully closed position (FIGS. 6 and 7). The eccentricity $e_2$ with which the spring force F acts on the projections 39 is therefore less, so that a smaller torsional moment $F.e_2$ acts on the hinge when the door is in its open position and tends to hold the door in its open position.

A second embodiment of the hinge according to the invention is illustrated in FIGS. 10 to 14. This only differs from the previous embodiment in that the outer link element has a different form; the outer element in this second embodiment is denoted by 16'.

It may be seen from FIGS. 10 to 14 that the outer link element 16' is plate-like, and the outer end **37*b* of this element 16' is rolled to form an articulation eye 54 which surrounds the movable hinge pin 33 of the element 16'. The element 16' has notches 55 on its face at its inner end 37*a*; these notches extend in the longitudinal direction of the element, and have a central portion 56 between them which is bent Just like the outer end 37*b* to form an articulation eye 57, which surrounds the fixed hinge pin 29 of the element 16'**.

The outer edge portions 58 formed by the notches 55 are bent back and are provided at their ends with angled portions 59 which form the projections on which the curved faces 48 and the vertexes 50 are disposed.

It may be seen from FIGS. 10 to 14 that the outer link element 16' fulfils the same function with its angled edge portions 58, 59 as does the outer link element 16 in the example described previously. When the door is opened the spring legs 46 of the spring element 31 slide on the curved face 48 of the angled edge portions 58, 59, whereupon the element 16' swings to end fro in the directions A and B, Just like the outer link element described with reference to the previous embodiment. The longitudinally extending legs 46 of the spring element 31 press against the vertex 50, which is located at the bend between the angled edge portions 58 and 59, just as in the embodiment described previously, and generate the closing moment $F.e_1$ or the moment $F.e_2$ which holds the door open when the hinge is situated in its fully closed position or fully open position, respectively.

Figure 12:
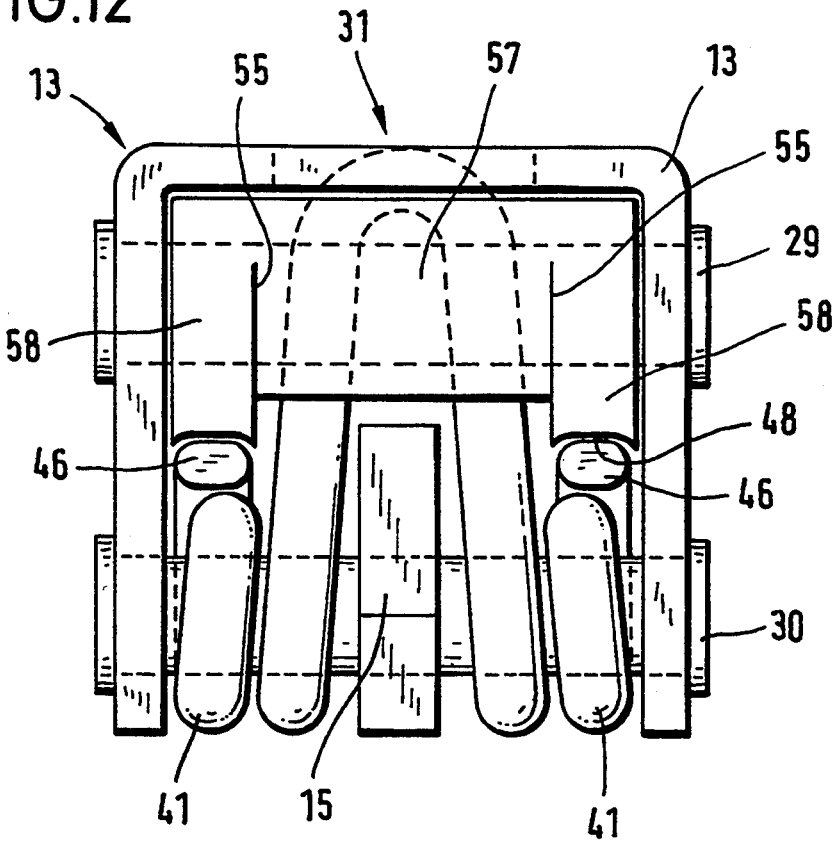
FIG. 12 is an illustration corresponding to FIG. 8, showing the link elements and spring means of the second embodiment.
Figure 11:
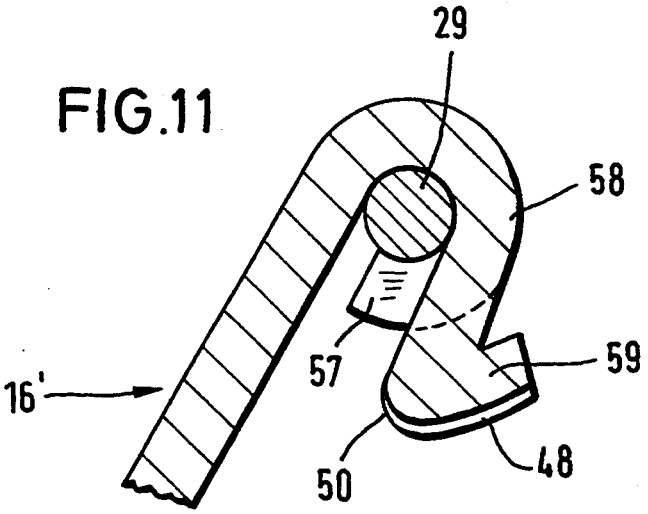
FIG. 11 is a partial longitudinal section along the line II—II of FIG. 10 but is shown on to a larger scale.
Figure 13:
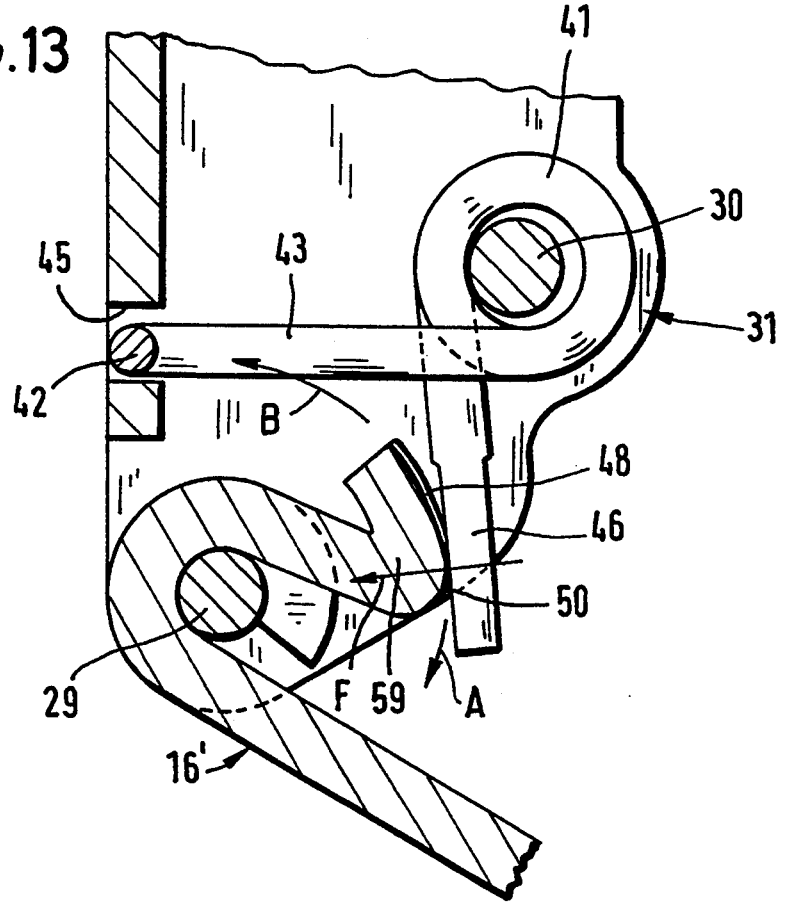
FIG. 13 is an illustration corresponding to FIG. 5, showing parts of the hinge of the second embodiment, with the hinge in an intermediate position.
Figure 14:
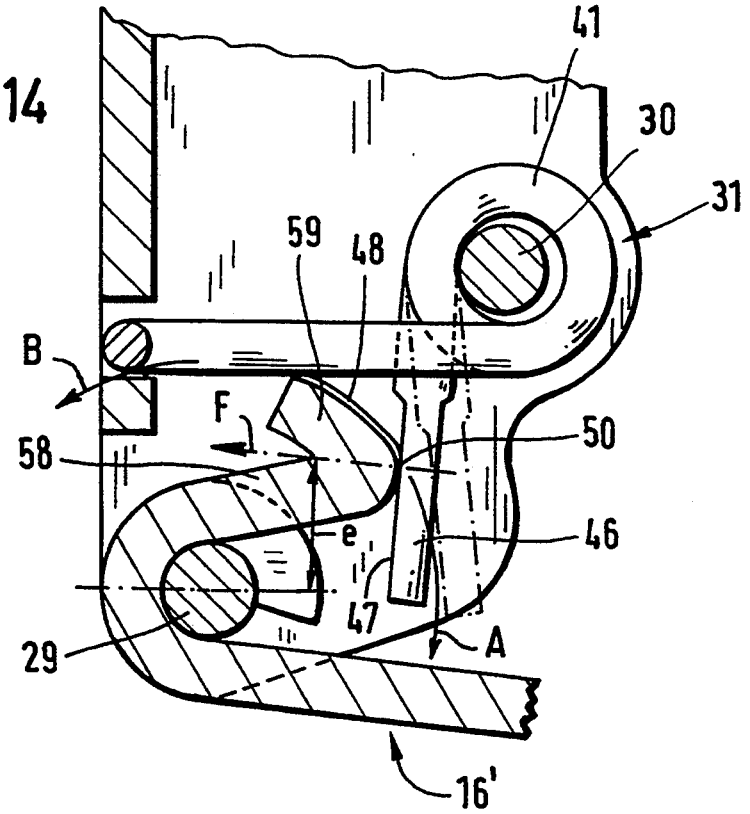
FIG. 14 is an illustration corresponding to FIG. 7, showing parts of the hinge of the second embodiment, with the hinge in its fully closed position.

It may also be seen from FIG. 12 that the spring element 31 may be accommodated in the first fastening element 13 and mounted there on the fixed hinge pin 30 of the inner link element, just as in the embodiment described previously.

The invention is not restricted to the embodiments described and illustrated. Rather, a number of modifications and additions are possible without departing from the scope of the invention. For example, instead of one spring element with two lateral turns, two individual leg springs could also be used, the central legs of which would bear against the fixed fastening element. Furthermore, the coil spring may also be manufactured from a steel wire with a square or rectangular cross-section, and it is also possible to support the central leg of the coil spring in another position. However, it is essential that at least one active spring leg of the spring element acts against the outer link element and not against the inner link element.

I claim:

1. A hinge comprising a fixed element, a movable element, an outer link, an inner link, each said outer and inner link having a first end pivotally connected to said fixed element at a corresponding first pivot axis and having a second end pivotally connected to said movable element at a corresponding second pivot axis, said outer and inner links pivotally supporting said movable element for displacement in an opening direction to an open position relative to said fixed element and in a closing direction to a closed position relative to said fixed element, said outer link comprising at least one curved face concentric with and spaced from said first pivot axis thereof, said curved face having an end and a vertex at said end, spring means comprising at least one spring element slidably engaging said curved face and applying a spring force radially toward said first pivot axis of said outer link during pivotal movement of said outer link in said opening and closing directions of said moveable element, and said spring element engaging said vertex and applying a moment to said outer link in each said open position and said closed position of said movable element.

2. A hinge according to claim 1, wherein said moment in each said open and closed position is in the same direction with respect to said first pivot axis of said outer link.

3. A hinge according to claim 1, wherein said outer link pivots in opposite directions about said first pivot axis thereof during movement of said movable element in each said opening direction and said closing direction.

4. A hinge element according to claim 1, wherein said outer link comprises two curved faces each having an end and a vertex at said end, said two curved faces being axially spaced apart with respect to said first pivot axis of said outer link and said curved faces and vertexes being axially aligned, and said spring means including two spring elements each for engaging a different one of said two curved faces and the corresponding vertex.

5. A hinge according to claim 4, wherein said spring means is in the form of a coil spring having a plurality of turns loaded in bending, a central leg and a pair of outer legs, said first pivot axis of said inner link comprising a hinge pin on said fixed element on which said spring is mounted through said turns, said outer legs providing said two spring elements engaging said curved faces of said outer link, and said central leg being supported on said fixed element.

6. A hinge according to claim 5, wherein said central leg of said spring means is generally U-shaped and comprises a pair of arms, said inner link being disposed between said arms.

7. A hinge according to claim 1, wherein said first pivot axis of said inner link comprises a hinge pin on said fixed element, and said spring means comprises a plurality of turns surrounding said hinge pin.

8. A hinge according to claim 1, wherein said at least one spring element comprises a flattened portion for engaging with said curved face and vertex.

9. A hinge according to claim 1, wherein at least a portion of said curved face and said vertex of said outer link are located laterally between the first and second pivot axes of said outer link, said first pivot axes of said outer and inner links being spaced apart on said fixed element, and said curved face being spaced from said first pivot axis of said outer link a distance less than the distance between the first pivot axes of said inner and outer links.

10. A hinge according to claim 1, wherein a plane through said vertex and coplanar with said first pivot axis of said outer link forms an acute angle with a plane through and coplanar with said first and second pivot axes of said outer link.

11. A hinge according to claim 12, wherein said outer link has a U-shaped cross-section including side flanges axially spaced apart with respect to said first pivot axis of said outer link, one of said flanges having said at least one curved face formed thereon.

12. A hinge according to claim 1, wherein said outer link is of generally plate form and includes notches in said first end transverse to said first pivot axis of said outer link, said notches defining a central portion having axially opposite sides and an edge portion outwardly adjacent each side, said central portion being tubular and having an axis coaxial with said first pivot axis of said outer link, and at least one of said edge portions being bent relative to said first pivot axis of said outer link to provide said at least one curved face and vertex.

13. A hinge according to claim 1, wherein said spring means is formed from spring wire having a round cross section, and said spring element comprises a portion of said wire flattened by pressing deformation and hardened by said deformation.

* * * * *